US009308721B2

(12) United States Patent
Uohashi et al.

(10) Patent No.: US 9,308,721 B2
(45) Date of Patent: Apr. 12, 2016

(54) METHOD OF MANUFACTURING SUBSTRATE FOR LIQUID EJECTION HEAD, SUBSTRATE FOR LIQUID EJECTION HEAD, LIQUID EJECTION HEAD, AND PRINTING APPARATUS

(71) Applicant: CANON KABUSHIKI KAISHA, Tokyo (JP)

(72) Inventors: Kunihito Uohashi, Yokohama (JP); Kenji Fujii, Yokohama (JP); Kazuhiro Asai, Kawasaki (JP); Keiji Matsumoto, Kawasaki (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/525,453

(22) Filed: Oct. 28, 2014

(65) Prior Publication Data

US 2015/0130874 A1 May 14, 2015

(30) Foreign Application Priority Data

Nov. 12, 2013 (JP) ..... 2013-233787

(51) Int. Cl.
*B41J 2/14* (2006.01)
*B41J 2/16* (2006.01)

(52) U.S. Cl.
CPC ..... *B41J 2/14016* (2013.01); *B41J 2/1433* (2013.01); *B41J 2/162* (2013.01); *B41J 2/1603* (2013.01); *B41J 2/1631* (2013.01); *B41J 2/1632* (2013.01); *B41J 2/1635* (2013.01); *B41J 2/1639* (2013.01); *B41J 2/1645* (2013.01)

(58) Field of Classification Search
CPC ..... B41J 2/14016; B41J 2/16; B41J 2/1433; B41J 2/1603; B41J 2/162; B41J 2/1631; B41J 2/1632; B41J 2/1635; B41J 2/1639; B41J 2/1645
USPC ..... 347/47, 50, 44; 29/890.1, 890.142; 427/265
See application file for complete search history.

(56) References Cited

U.S. PATENT DOCUMENTS

| | | | | |
|---|---|---|---|---|
| 8,753,800 | B2 | 6/2014 | Uohashi et al. | |
| 8,778,599 | B2 | 7/2014 | Uohashi et al. | |
| 2013/0330673 | A1* | 12/2013 | Uohashi | B41J 2/1631 430/320 |
| 2014/0083974 | A1 | 3/2014 | Matsumoto et al. | |

FOREIGN PATENT DOCUMENTS

| | | | |
|---|---|---|---|
| JP | 2007-296694 | A | 11/2007 |

* cited by examiner

*Primary Examiner* — Henok Legesse
(74) *Attorney, Agent, or Firm* — Fitzpatrick, Cella, Harper & Scinto

(57) ABSTRACT

A method of manufacturing a substrate for a liquid ejection head including an ejection port forming member which has formed therein ejection ports, includes the steps of: forming a first layer by using a first layer forming member; forming a second layer on the first layer by using a second layer forming member; and hardening a partial region of each of the first layer and the second layer and removing a region different from the partial region so as to form the ejection ports, resulting in that the first layer and the second layer constitute the ejection port forming member, and a member containing a solvent to dissolve the first layer forming member and a photo-acid-generating agent having an acid strength weaker than an acid strength of the photo-acid-generating agent contained in the first layer forming member is used as the second layer forming member.

7 Claims, 7 Drawing Sheets

METHOD OF MANUFACTURING SUBSTRATE FOR LIQUID EJECTION HEAD, SUBSTRATE FOR LIQUID EJECTION HEAD, LIQUID EJECTION HEAD, AND PRINTING APPARATUS

BACKGROUND OF THE INVENTION

1. Field of the Invention

The present invention relates to a method of manufacturing a substrate for a liquid ejection head, a substrate for a liquid ejection head, a liquid ejection head, and a printing apparatus.

2. Description of the Related Art

As a substrate for a liquid ejection head in which ejection ports to eject liquid are disposed, a printing element substrate for use in a printing head of an ink jet printing apparatus has been known. As a method of forming ejection ports in this printing element substrate, Japanese Patent Laid-Open No. 2007-296694 discloses a method of forming ejection ports in which a photosensitive resin is used as an ejection port forming member, and an exposing process and a developing process are performed for the photosensitive resin.

In a printing apparatus, ink droplets are ejected from the ejection ports of a printing head so as to print images on a printing medium. Accordingly, the quality of the images is influenced by the size and shape of each of the ejection ports. In order to print images with high quality, it is preferable that ink droplets each having the same volume are ejected at the same ejection speed in the same direction.

However, ink mist generated together with ink droplets tends to adhere on ejection ports and a surface on which the ejection ports are formed. In the case where the adhering matters obstruct ejection of ink from the ejection ports, a difference in an amount of ink droplets ejected from an ejection port may be caused among the ejection ports, which may result in deterioration of image quality. In order to prevent such a situation, in a known method, a wiping operation is performed so as to move a wiper blade while bringing the wiper blade in contact with a surface on which ejection ports are formed, thereby removing adhering matters.

SUMMARY OF THE INVENTION

The present invention provides a method of manufacturing a substrate for a liquid ejection head so as to form ejection ports each having an aperture end portion in a shape hard to contact with a wiper blade. The present invention further provides a substrate for a liquid ejection head, a liquid ejection head, and a printing apparatus.

According to a first aspect of the present invention, a method of manufacturing a substrate for a liquid ejection head including an ejection port forming member which has formed therein ejection ports opened to a surface for ejection liquid, the method including the steps of:

forming a first layer by using a first layer forming member containing a solvent and a photo-acid-generating agent;

forming a second layer on the first layer by using a second layer forming member containing a solvent and a photo-acid-generating agent; and hardening a partial region of each of the first layer and the second layer and removing a region different from the partial region so as to form the ejection ports, resulting in that the first layer and the second layer constitute the ejection port forming member, wherein a member containing a solvent to dissolve the first layer forming member and a photo-acid-generating agent having an acid strength weaker than an acid strength of the photo-acid-generating agent contained in the first layer forming member is used as the second layer forming member.

According to the above configuration, a member containing a solvent to dissolve the first layer forming member and a photo-acid-generating agent having an acid strength weaker than that of the photo-acid-generating agent contained in the first layer forming member is used as the second layer forming member. In this way, a compatible layer of the first layer forming member and the second layer forming member is formed, and a hardened state is made different depending on an existence ratio of the first layer forming member and the second layer forming member in the compatible layer. In concrete terms, in the compatible layer, a portion at a second layer side where the existence rate of the second layer forming member is comparatively large is made more difficult to be hardened than a portion at a first layer side where the existence rate of the first layer forming member is comparatively large. With this, the area of an aperture in an aperture end portion of an ejection port formed in the compatible layer is made comparatively narrow at the first layer side and is made wider at the second layer side becoming a surface side of the ejection port forming member than at the first layer side. Accordingly, according to the present invention, it becomes possible to form ejection ports each having an aperture end portion in a shape hard to contact with a wiper blade.

Further features of the present invention will become apparent from the following description of exemplary embodiments (with reference to the attached drawings).

BRIEF DESCRIPTION OF THE DRAWINGS

FIG. 6B is a plan view in which FIG. 6A is viewed from a z-direction downstream side;

DESCRIPTION OF THE EMBODIMENTS

In the constitution of ejection ports formed by the method disclosed by Japanese Patent Laid-Open No. 2007-296694, at the time of wiping, an aperture end portion of an ejection port may come in contact with a wiper blade. At this time, depending on an extent of the strength of a force applied to the ejection port, the ejection port may be damaged. If the ejection ports are damaged, a difference in an amount of ink droplets ejected from an ejection port may be caused among the ejection ports, or an ejection direction may be deviated, which may result in deterioration of image quality. The present invention intends to solve the above problems.

Hereinafter, an embodiment of the present invention will be described in detail with reference to drawings.

Embodiment

Figure 1:
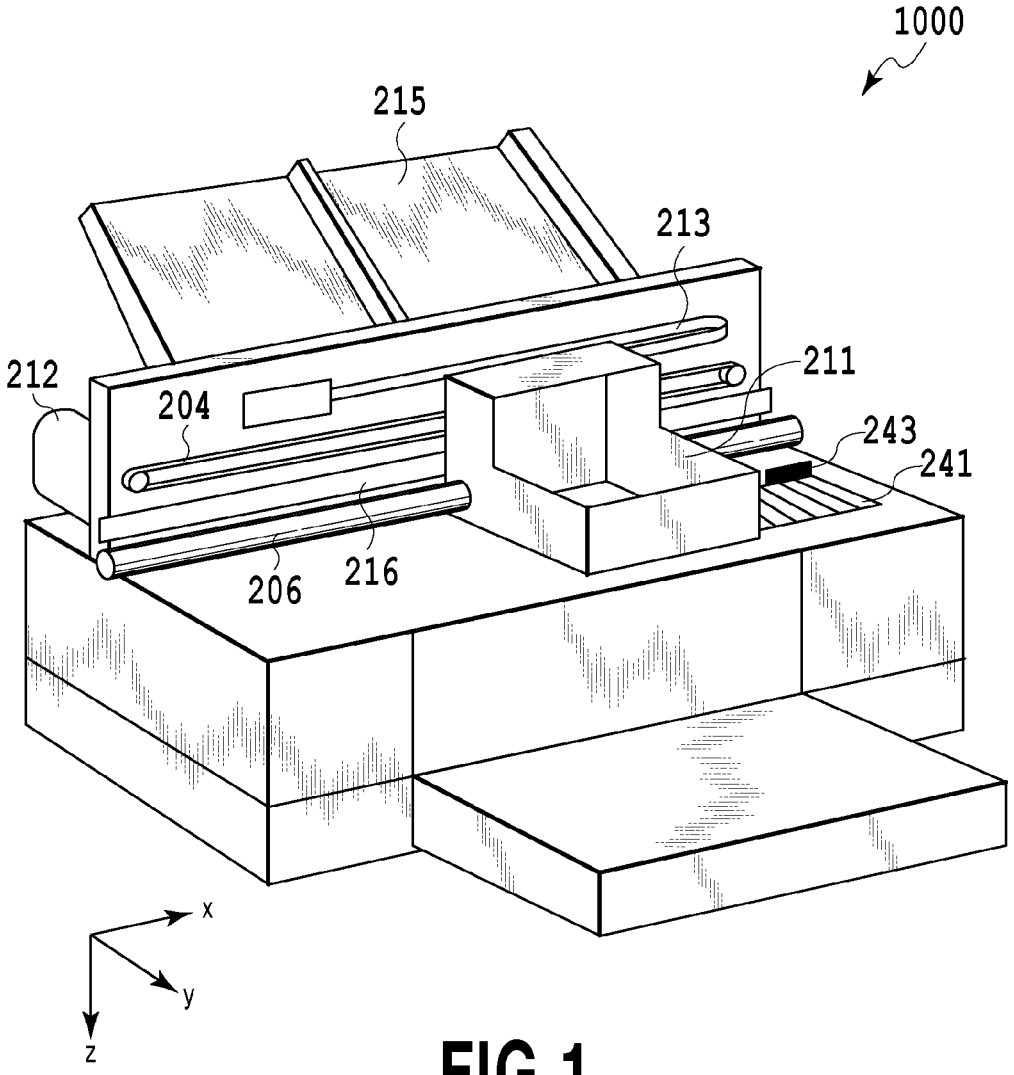
FIG. 1 is a perspective view showing a constitution of an ink jet printing apparatus.

FIG. 1 is a perspective view showing a constitution of an ink jet printing apparatus (hereinafter, referred to as a "printing apparatus") 1000 using an ink jet printing head (hereinafter, referred to as a "printing head") as a liquid ejection head according to this embodiment.

The printing apparatus 1000 includes a carriage 211 which accommodates a print head cartridge (hereinafter, referred to as a "head cartridge") 100 which is described later with reference to FIGS. 2A and 2B. In the printing apparatus 1000 of this embodiment, the carriage 211 is guided so as to be movable in the main scanning direction (in the drawing, the x direction) along a guide shaft 206. The guide shaft 206 is arranged so as to be extended in the width direction of a printing medium. Therefore, the printing head of the head cartridge 100 mounted on the carriage 211 is configured to perform printing wile scanning in the direction intersecting with the conveying direction (in the drawing, the y direction) of a printing medium.

In this embodiment, the guide shaft 206 is made to penetrate the carriage 211 so as to support it, whereby the carriage 211 can scan in the direction orthogonal to the conveying direction of a printing medium. A belt 204 is attached to the carriage 211, and a carriage motor 212 is attached to the belt 204. With this constitution, since a driving force by the carriage motor 212 is transmitted to the carriage 211 via the belt 204, the carriage 211 is configured to be movable in the x direction while being guided by the guide shaft 206.

Further, a flexible cable 213 to transfer electrical signals from a control section (not-shown) to a later-mentioned printing head 104 is attached to the carriage 211 so as to be connected to an electric wiring member 102 of the printing head 104. On the printing apparatus 1000, a cap 241 and a wiper blade 243 which are used for performing a recovering process of the printing head 104 are disposed. Further, the printing apparatus 1000 includes a sheet feeding section 215 to feed a printing medium into its inner side and an encoder sensor 216 to read the position of the carriage 211 optically.

The printing apparatus 1000 is configured to print images sequentially on a printing medium by repeating a printing operation to jet out ink from a printing head toward the z direction while moving the printing head in the x direction and a conveying operation to convey the printing medium in the y direction.

Figure 2A:
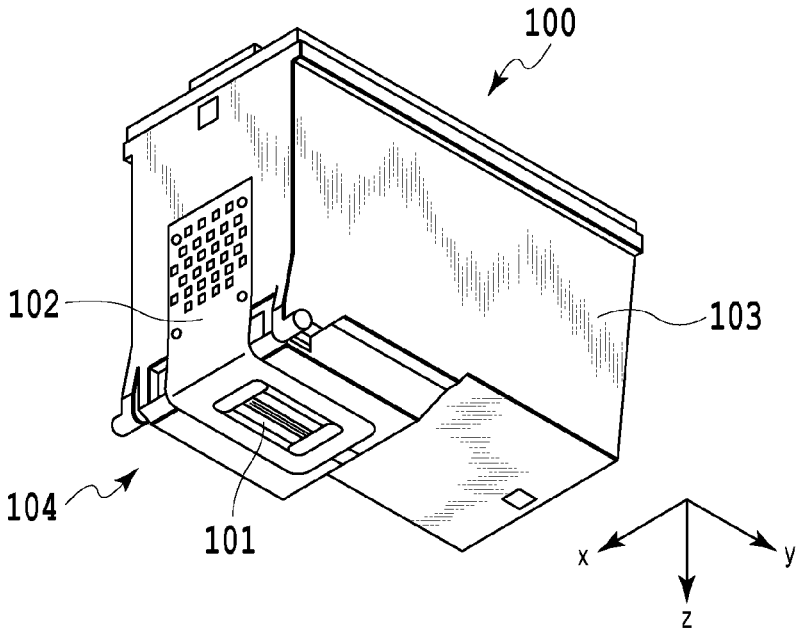
FIG. 2A is a perspective view showing a constitution of a head cartridge.
Figure 2B:
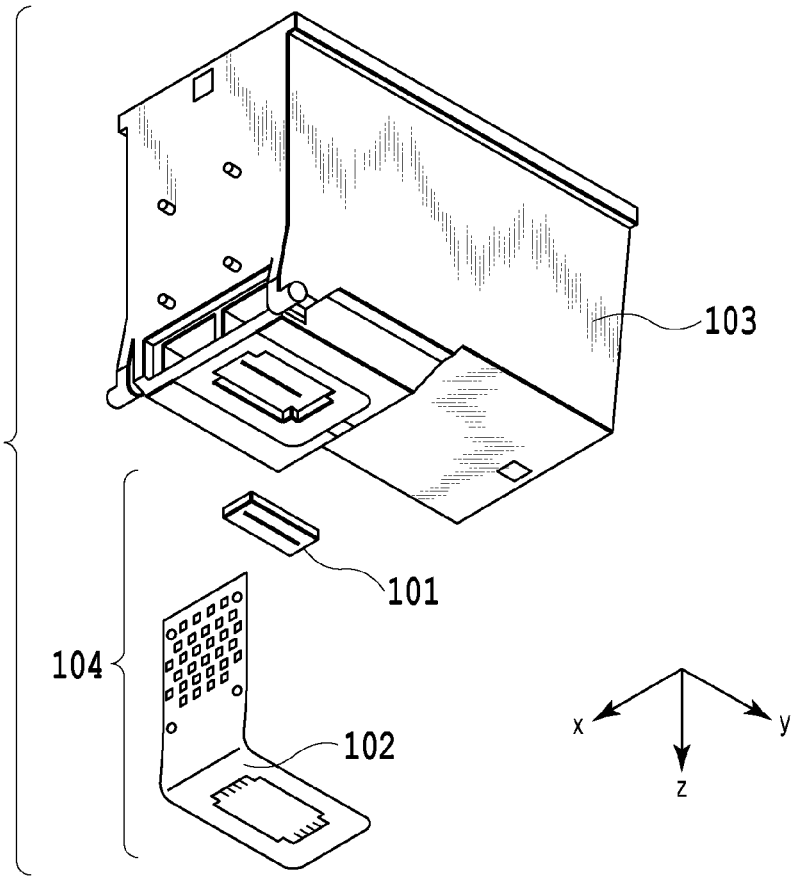
FIG. 2B is an exploded perspective view showing an exploded printing head.

FIG. 2A is a perspective view of the head cartridge 100 in which the printing head 104 and the ink container 103 are integrally constituted, and FIG. 2B is an exploded perspective view showing the exploded printing head 104. Here, description is given to an embodiment in which a printing head and an ink container are integrally constituted. However, the ink container may be constituted to be detachably attached to the printing head.

As shown in FIG. 2A, the head cartridge 100 is constituted so as to include the printing head 104 and the ink container 103. Further, as shown in FIG. 2B, the printing head 104 includes a printing element substrate 101 serving as a substrate for a liquid ejection head and an electric wiring member 102.

Figure 3:
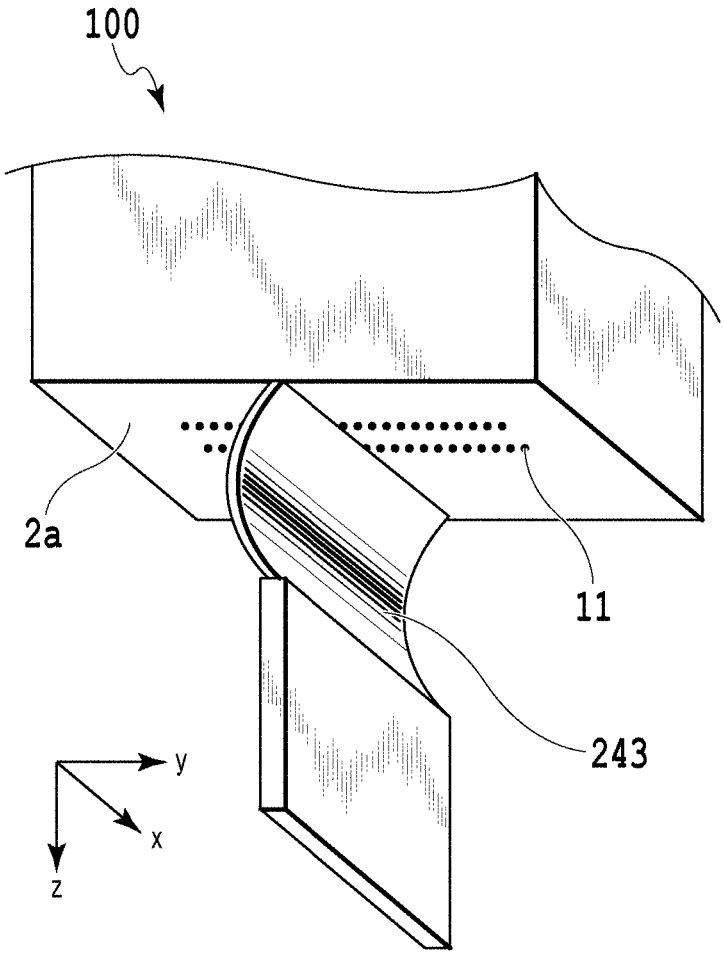
FIG. 3 is an illustration for illustrating a wiping operation.
Figure 4:
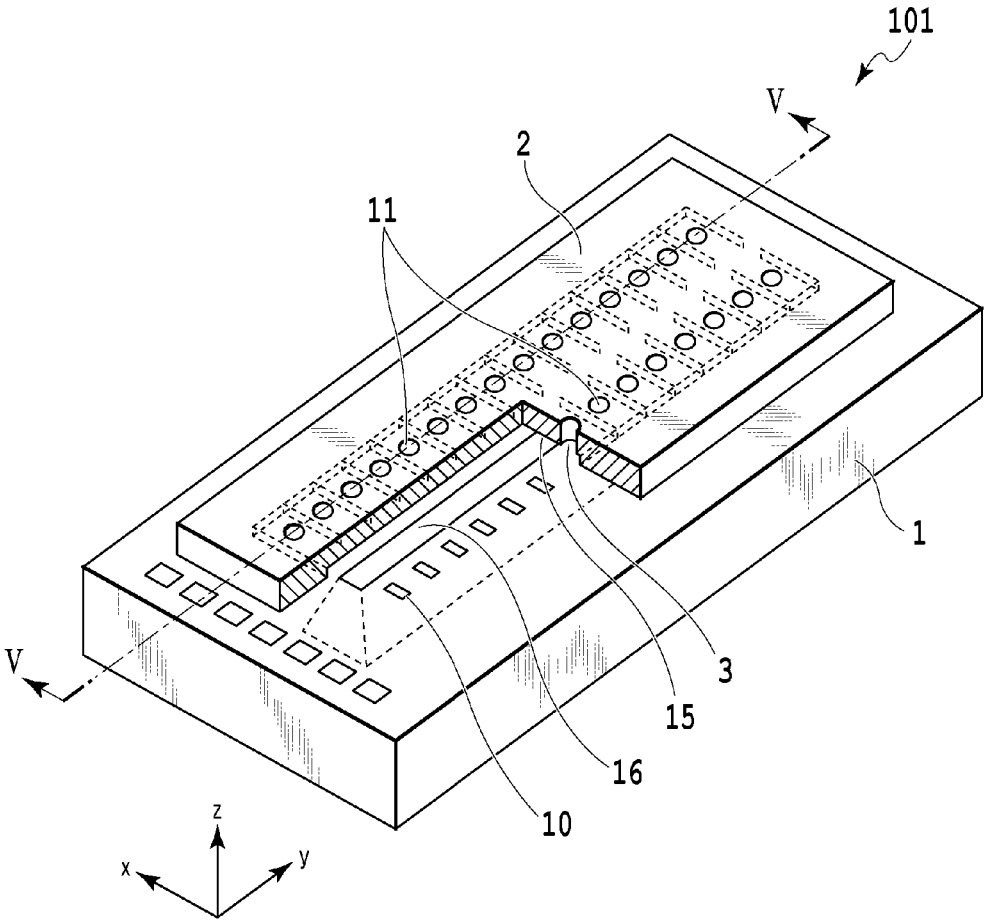
FIG. 4 is a perspective view showing a constitution of a printing element substrate.

On one surface of the printing element substrate 101, a plurality of electrothermal conversion elements 10 and electric wirings, which will be described with reference to FIGS. 3 and 4, are formed. The electrothermal conversion elements 10 are used as elements to generate energy for ejection ink, and the wirings are adapted to feed electric power to the electrothermal conversion elements 10. In the printing element substrate 101, an ejection port forming member 2 to form a plurality of ejection ports is formed by a photolithography technique. Further, in the printing element substrate 101, an ink feeding port 16 to feed ink to a channel 15 is formed so as to penetrate the substrate.

The electric wiring member 102 is provided with an opening through which the printing element substrate 101 is incorporated, and inner lead wires corresponding to electric connecting portions to be connected to electric wirings formed on the printing element substrate 101. The inner lead wires are formed so as to be extended in the opening and arranged side by side in a predetermined direction.

Further, the electric wiring member 102 is provided with input terminals to receive drive control signals from the printing apparatus 1000 by being connected to electric contacts of the printing apparatus 1000. The input terminals are formed to be able to be connected to the electric contacts of the printing apparatus 1000, and the input terminals and the inner lead wires are coupled to each other via electric wirings. Examples of the electric wiring member 102 include a TAB (Tape Automated Bonding) type tape.

FIG. 3 is an illustration for illustrating a wiping operation. Although the details will be described later with reference to FIG. 4, on the printing head 104, a plurality of ejection ports 11 are formed on a surface which mutually faces a printing medium at the time of printing. When ink is ejected from the ejection ports 11, ink mist is generated together with ink droplets, and the ink mist may adhere to an ejection port forming surface 2*a* on which the ejection ports 11 are formed. If such ink mist adheres to the ejection ports 11 and their peripheries, an error may arise in an amount of ink ejected from each of the ejection ports, or the ink ejection direction may deviate, which leads to deterioration in an image quality.

In order to prevent this, a wiper blade 243 is made to move in the y direction while being pressed onto the ejection port forming surface 2*a*, whereby the wiper blade 243 is brought in contact with the attached matters adhering on the ejection port forming surface 2*a* and wipes them off. With this wiping operation, the attached matters which obstruct ejection of ink from the ejection ports 11 are removed.

Here, in this embodiment, the description has been given to the constitution that the wiper blade 243 is made to move in the arranging direction (the y direction) of the ejection ports 11. However, the moving direction of the wiper blade 243 should not be limited to this direction. For example, the wiper blade 243 may be configured to move in the direction (the x direction) intersecting with the arranging direction of the ejection ports 11.

In this embodiment, the ejection ports 11 are prevented from being damaged due to contact of the wiper blade 243 with the aperture end portion of each of the ejection ports 11 at the time of the wiping operation.

FIG. 4 is a perspective view showing the constitution of the printing element substrate 101. As shown in FIG. 4, the printing element substrate 101 is constituted by a substrate 1, an ejection port forming member 2, and the like. In FIG. 4, although only one row is illustrated, two rows of the plurality of electrothermal conversion elements 10 formed at a predetermined pitch are formed on the substrate 1 along the y direction in the drawing. On the substrate 1, an ink feeding port 16 is formed so as to open between the two rows of the electrothermal conversion elements 10.

Further, the ejection port forming member 2 is formed on the surface of the substrate 1 at the +z-direction side in the drawing. In the ejection port forming member 2, an ejection port group and a flow channel 15 are formed. The ejection port group is composed of a plurality of ejection ports 11 each made to open to the surface of the ejection port forming member 2, and the flow channel 15 is made to communicate from the ink feeding port 16 to each of the ejection ports 11. Each of the ejection ports 11 is formed at a position mutually facing a corresponding one of the electrothermal conversion elements 10.

Figure 5:
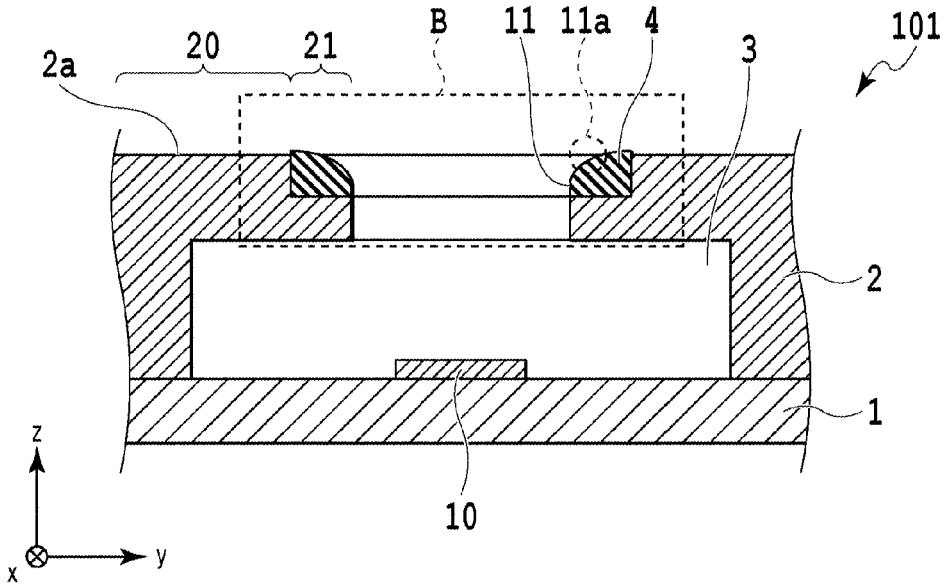
FIG. 5 is a cross sectional view showing the printing element substrate.

FIG. 5 is across sectional view showing the printing element substrate 101 in this embodiment. As shown in FIG. 5, also as mentioned above, the printing element substrate 101 is constituted by the ejection port forming member 2 on which the ejection ports 11 are formed, and the substrate 1 on which the electrothermal conversion elements 10 are formed.

As shown in FIG. 5, on the ejection port forming surface 2*a* which is a surface configured to mutually face a printing medium at the time of printing and a surface on which the ejection ports are formed, a water non-repellent region 20 and a water repellent region 21 are disposed. In concrete terms, the water repellent region 21 is disposed so as to enclose the outer periphery of each of the ejection ports 11, and the water non-repellent region 20 is disposed so as to enclose the outer periphery of the water repellent region 21. By disposing the water repellent region 21 on the periphery of each of the ejection ports 11, ink is suppressed from adhering onto the ejection ports 11.

Here, although description is given to a constitution in which the water repellent region 21 is disposed, as described in Example 3 mentioned later, the constitution may be made not to dispose the water repellent region 21.

As shown in FIG. 5, in the ejection port forming member 2, liquid chambers 3 to store ink are disposed. Further, although not illustrated, in the substrate 1, a thin film is formed for the purposes of protection from ink, insulation, and the like.

Figure 6A:
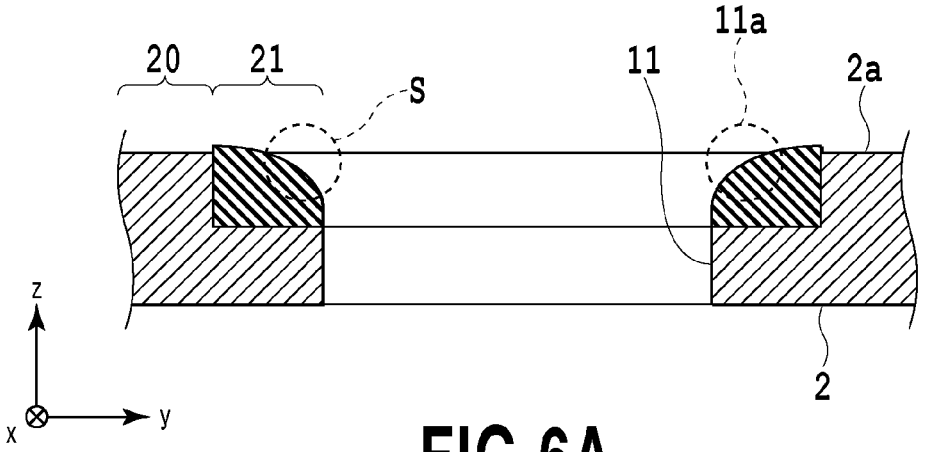
FIG. 6A is an enlarged sectional view showing an enlarged view of a region B shown in FIG. 5.
Figure 6B:
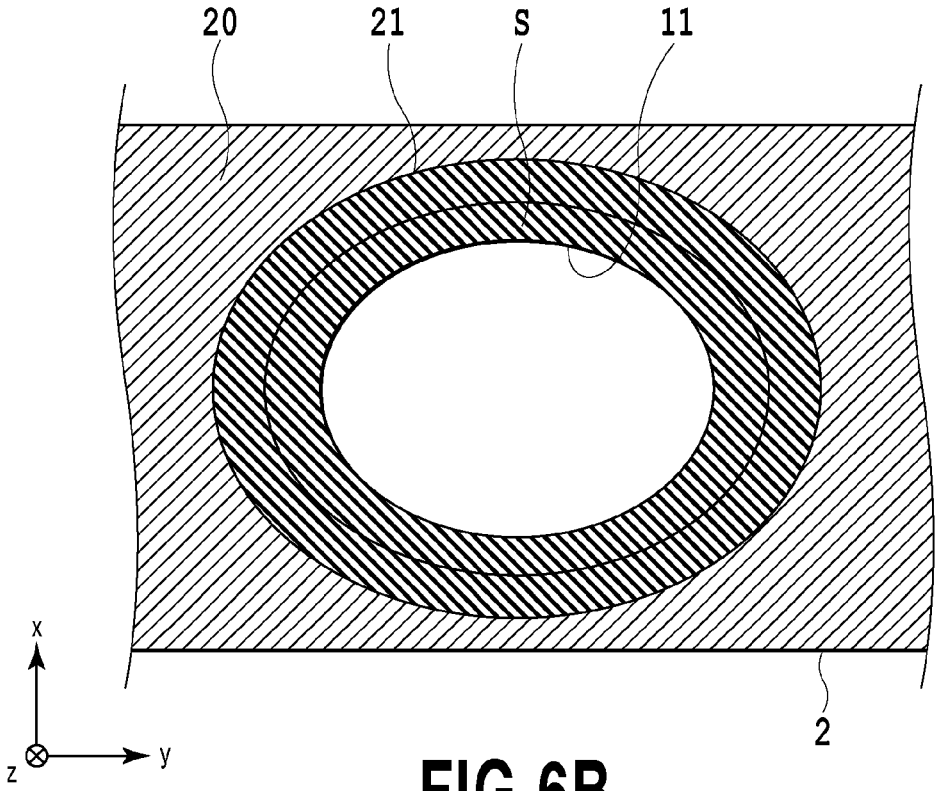

FIG. 6A is an enlarged sectional view showing an enlarged view of a region B shown in FIG. 5, and FIG. 6B is a plan view in which FIG. 6A is viewed from the +z-direction side (the z-direction downstream side).

As shown in FIG. 6A, the ejection port 11 in this embodiment has a shape in which the area of an aperture on the ejection port forming surface 2*a* is wider than the area of an aperture at the ejection direction (the z-direction) upstream side. That is, in this embodiment, the area of an aperture at the ejection direction downstream side is wider than the area of an aperture at the ejection direction upstream side in the aperture end portion 11*a* of the ejection port 11. In this embodiment, by providing such a difference in the area of an aperture to the ejection port 11, the ejection port 11 can be suppressed from being damaged due to the contact of the aperture end portion 11*a* with the wiper blade 243.

Further, in the constitution in which the water repellent region 21 is disposed as with this embodiment, the wiper blade 243 and the aperture end portion 11*a* are made hard to contact with each other. Accordingly, it becomes possible to suppress deterioration of the water repellent function due to damage of a water repellent layer of the aperture end portion 11*a*.

As shown in FIG. 6B, by disposing the water non-repellent region 20 at a position located slightly apart from the outer periphery of the ejection port 11 across the water repellent region 21, ink is collected in the water non-repellent region 20, whereby the ink is prevented from moving toward the ejection port 11. With this, it becomes possible to prevent the situation that ink staying on the ejection port forming surface 2*a* moves toward the ejection port 11 and closes the ejection port 11 so as to obstruct ejection of ink from the ejection port 11.

Further, a slope S is disposed on the aperture end portion 11*a* of the ejection port 11. The slope S is disposed from the ejection port forming surface 2*a* side toward the ejection direction (in the drawing, the arrow z direction) upstream side, and the aperture end portion 11*a* of the ejection port 11 is shaped to have no corner. With such a configuration, even if the aperture end portion 11*a* and the wiper blade 243 come in contact with each other, the wiper blade 243 is made to move along the slope surface S, whereby it becomes possible to disperse a pressure applied on the aperture end portion 11*a* and to prevent the ejection port 11 from being damaged.

Further, in this embodiment, by disposing the water repellent region 21 on the slope S portion, ink droplets repelled on the water repellent region can be made to move along the slope S with gravity and to move toward the water non-repellent region 20.

FIG. 7A to 7H each are cross sectional views for illustrating the manufacturing method of the printing element substrate 101 in this embodiment, and show a cross section in the vicinity of one of the ejection ports 11 in the cross section taken along a V-V line shown in FIG. 4. Hereinafter, description is given to the manufacturing process of the head cartridge 100 equipped with the printing element substrate 101 while taking the forming process of the ejection port 11 at the center of the description.

Figure 7A:
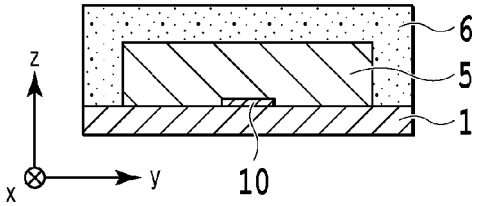
FIG. 7A is a cross sectional view for illustrating a manufacturing method of the printing element substrate.

First, as shown in FIG. 7A, on the substrate 1 on which an electrothermal conversion element 10 and a liquid chamber forming layer 5 are formed, a negative type photosensitive resist (hereinafter, referred to as "resist") 6 is formed. Here, in this embodiment, the liquid chamber forming layer 5 is formed on the substrate 1 by using a molding member.

The resist (the first layer forming member) 6 is a chemical amplification type resist, and in the resist forming unit, the resist may be coated by a solvent coating method, or a dry film may be produced from the resist and transferred onto the substrate. Here, in the solvent coating method used in this embodiment, a photosensitive material solution is coated on the substrate by using a spin coater, a roll coater, a slit coater, a wire bar coater, or the like, and thereafter, the solvent is dried and removed, whereby a photosensitive material layer is formed.

Figure 7B:
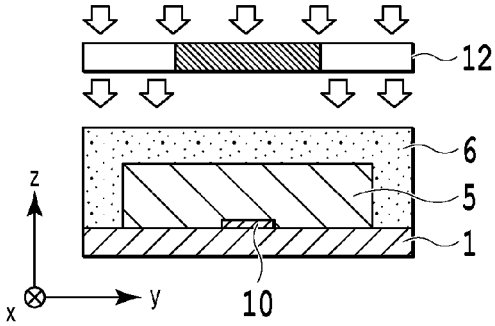
FIG. 7B is a cross sectional view for illustrating the manufacturing method of the printing element substrate.

Next, as shown in FIG. 7B, the resist 6 is subjected to an exposing process, and a post-exposing baking process (hereinafter, referred to as "PEB (Post Exposure Bake)"). At this time, since a portion which has sensed light becomes a water non-repellent region, an exposure mask 12 is prepared so as to have a pattern to expose a water non-repellent region, i.e., only an outside of a region larger by one size than an ejection port to light. In this connection, each of an exposure amount and the PEB condition may be set to an optimal condition capable of forming a desired pattern, and should not be limited particularly.

Figure 7C:
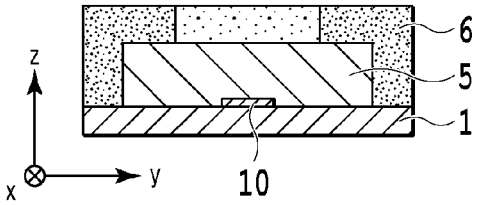
FIG. 7C is a cross sectional view for illustrating the manufacturing method of the printing element substrate.

Since the resist 6 contains a photo-acid-generating agent photo-acid-generating agent, as shown in FIG. 7C, the resist 6 in a region exposed to light via the exposure mask 12 is hardened with acid generated by absorption of light. On the other hand, in the resist 6 in a region having been not exposed to light via the exposure mask 12, a hardening reaction does not advance.

Figure 7D:
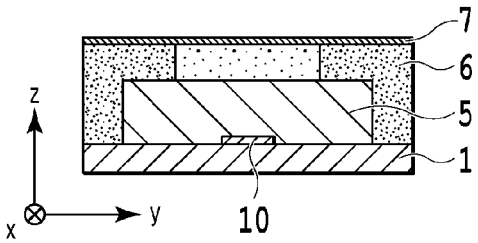
FIG. 7D is a cross sectional view for illustrating the manufacturing method of the printing element substrate.

Next, as shown in FIG. 7D, on the resist 6, a water repellent agent (the second layer forming member) 7 is coated and dried. In the water repellent agent 7, in addition to a water repellent component, a photosensitive resin, a solvent, and a photo-acid-generating agent are added.

Figure 7E:
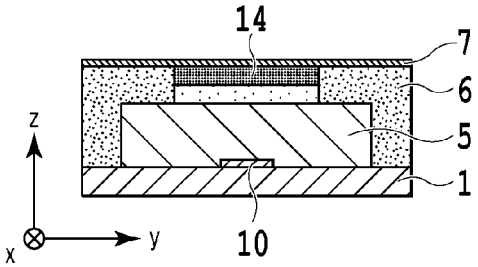
FIG. 7E is a cross sectional view for illustrating the manufacturing method of the printing element substrate.

In this embodiment, as a solvent to be contained in the water repellent agent 7, a solvent capable of dissolving the resist 6 is selected, whereby a compatible layer 14 of a non-hardened portion of the resist 6 and the water repellent agent 7 is formed as shown in FIG. 7E. Since the shape of the aperture end portion of the ejection port formed in a portion of the compatible layer may change depending on the kind of the solvent, the kind of a solvent to be contained in the water repellent agent 7 is selected in accordance with a desired shape of an ejection port. It is preferable that a difference between the solubility parameter (SP value) of a solvent to be contained in the water repellent agent 7 and the solubility parameter (SP value) of a solvent to be contained in the resist 6 is a predetermined value (here, four or less as an absolute value).

Further, in the meaning of the term "compatibility" in this embodiment, it is not necessary for the resist 6 and the water repellent agent 7 to be mixed with each other in molecular level, and it may be permissible for them to exist together in a prescribed region. In FIG. 7B, the resist 6 in the region having been exposed to light has been hardened by a cross-linking reaction. Accordingly, dissolution by the solvent has hardly advanced so that a compatible layer is not formed.

The kind of a photo-acid-generating agent to be contained in the water repellent agent 7 should not be limited. However, as described later, since the shape of an ejection port changes depending on the relationship with a photo-acid-generating agent contained in the resist 6, the kind of a photo-acid-generating agent to be contained in the water repellent agent 7 is selected in accordance with a desired shape of an ejection port.

Figure 7F:
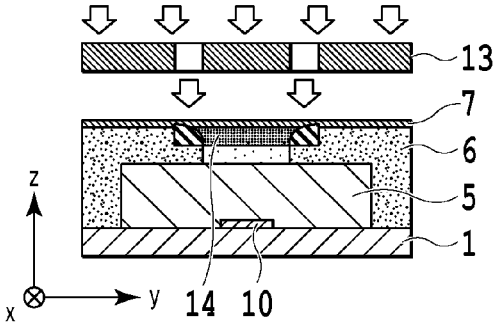
FIG. 7F is a cross sectional view for illustrating the manufacturing method of the printing element substrate.

Successively, as shown in FIG. 7F, the exposing process and the PEB are performed. At this time, since portions which have been exposed to light become an ejection port pattern and a water repellent region, in this embodiment, an exposure mask 13 is prepared so as to have a pattern to expose only the water repellent region in addition to the ejection port pattern. That is, the exposure mask 13 configured to expose a partial region to light, is prepared.

Since each of the resist 6 and the water repellent agent 7 contains a photo-acid-generating agent, in a region exposed to light via the exposure mask 13, acid is generated, and the region is hardened. The hardened portion is not dissolved by a developing fluid. Accordingly, the hardened portion is not removed in a developing process. On the other hand, in a region having been not exposed to light via the exposure mask 13, a hardening reaction does not advance. Accordingly, the region is removed in the developing process.

In this embodiment, since the water repellent agent 7 contains a water repellent component, the region having been exposed to light via the exposure mask 13 exhibits repellency. With this, in a latter process shown in FIG. 7G, a water repellent layer 4 is formed. In this connection, each of an exposure amount and the PEB condition may be set to an optimal condition capable of forming a desired pattern, and should not be limited particularly.

Figure 7G:
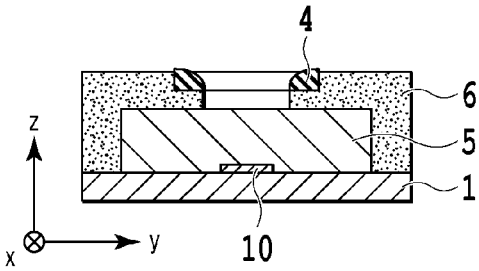
FIG. 7G is a cross sectional view for illustrating the manufacturing method of the printing element substrate.
Figure 7H:
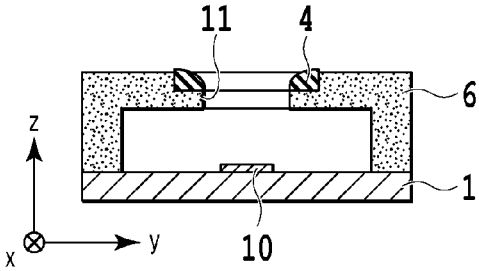
FIG. 7H is a cross sectional view for illustrating the manufacturing method of the printing element substrate.

Successively, as shown in FIGS. 7G and 7H, the developing process is performed, whereby the liquid chamber forming layer 5 is removed. In this embodiment, since a negative type photosensitive resist is used as the resist 6, at the time of development, regions having been exposed to light through the exposure masks 12 and 13 are made to remain.

Although the compatible layer 14 is a layer in which the non-hardened portion of the resist 6 and the water repellent agent 7 exist together, in the existence ratio of the two materials, there is gradation in the z direction in the drawing. In concrete terms, since the water repellent agent 7 tends to permeate the resist 6 with the solvent, the existence rate of the water repellent agent 7 decreases gradually toward the −Z direction side (the substrate 1 side).

In this embodiment, the sensitivity of the water repellent agent 7 to exposure light is made lower than the sensitivity of the resist 6 to exposure light. With this, in the compatible layer 14, the gradation of the sensitivity occurs in response to the existence rate of the water repellent agent 7.

In concrete terms, since the sensitivity of the resist 6 is made higher than the sensitivity of the water repellent agent 7, the sensitivity of the compatible layer 14 becomes gradually high toward the −z direction side. Since an amount of acid generated by exposure light is small in a region with a relatively low sensitivity, edge portions of a pattern are not hardened sufficiently, and then the edge portions are dissolved in the developing fluid. Accordingly, the area of an aperture at the ejection port forming surface 2*a* side becomes comparatively large. On the other hand, since an amount of acid generated by exposure light is sufficient in a region with a relatively high sensitivity, edge portions of a pattern are hardened sufficiently. Therefore, the area of an aperture at the upstream side in the ink ejection direction (the z direction) becomes narrow as compared with the area of an aperture at the ejection port forming surface 2*a* side.

That is, the area of an aperture of the ejection port pattern formed in the compatible layer 14 becomes small gradually toward the −z direction side. With this, as shown in FIG. 5, the area of an aperture on the ejection port forming surface 2*a* is made larger than the area of an aperture at the upstream side in the ejection direction, and the ejection port 11 with a shape in which a corner portion (aperture end portion) is rounded is formed. Although the size of this R shape changes depending on the kind of a solvent, the process conditions, and the like, it is possible to form the R shape with a radius of almost 0.1 to 5.0 μm.

Subsequently, unnecessary portions are cut out and by using a dicing saw, and the printing element substrate 101 is separated into chips. In order to drive the electrothermal conversion elements 10, the printing element substrate 101 separated into chips is electrically connected to the electric wiring member 102, and thereafter, in order to feed ink, the printing element substrate 101 is connected to the ink container 103, whereby the head cartridge 100 shown in FIG. 1 is completed.

As mentioned above, in this embodiment, the water repellent agent 7 is made to contain a solvent capable of dissolving the resist 6, and the sensitivity of the water repellent agent 7 to exposure light is made lower than that of the resist 6 to exposure light, thereby forming a compatible layer of the resist 6 and the water repellent agent 7, and forming a slope S. In this embodiment, since the slope S is disposed on the aperture end portion 11*a*, it is possible to form an ejection port 11 with a shape in which an aperture end portion 11*a* is hard to contact with a wiper blade 243 at the time of wiping.

Next, description is given to specific examples of the present invention.

EXAMPLE 1

With reference to FIGS. 7A to 7H, a method of forming an ejection port 11 according to this embodiment is described.

First, as shown in FIG. 7A, a resist 6 was formed on a liquid chamber forming layer 5. The liquid chamber forming layer 5 was formed in such a way that a positive type photosensitive resin was coated on the substrate 1, exposed to light, and developed. The resist 6 was a negative type resist containing a solid content composed of epoxy resin, a solvent composed of propylene glycol monomethyl ether acetate (hereinafter, referred to as "PGMEA"), and a photo-acid-generating agent. As the photo-acid-generating agent, a photo-acid-generating agent composed of triaryl sulfonium salt was selected. As the forming method, a spin coating method was selected, and a film thickness was made to 10 μm.

After the resist 6 was formed, as shown in FIG. 7B, the exposing process for water non-repellent regions 20 and the PEB were performed. In this example, the exposing process was performed with an exposure amount of 5000 [J/m$^2$], and the PEB was performed on the conditions of a temperature of 50° C. and a processing time of 10 minutes, thereby reducing as small as possible a phenomenon that unexposed portions sink relative to exposed portions. As a result, an amount of sinking of the unexposed portions relative to the exposed portions was suppressed to 0.2 μm.

Since the resist 6 contains a photo-acid-generating agent, as shown in FIG. 7C, in the resist 6 in a region exposed to light via the exposure mask 12, acid was generated, and the region was hardened. On the other hand, in the resist 6 in a region having been not exposed to light via the exposure mask 12, a hardening reaction did not advance.

Next, as shown in FIG. 7D, a water repellent agent 7 was applied on the resist 6. As the applying method, an applying method with a slit coater was selected. In the water repellent agent 7, in addition to a water repellent component, a photosensitive resin, a solvent, and a photo-acid-generating agent were added. However, as mentioned above, depending on the selection of the kind of each of them, the shape of an ejection port may become different.

In the water repellent agent 7 in this example, epoxy resin was selected as the photosensitive resin. A solvent (ethanol) incapable of dissolving the resist 6 and a solvent (PGMEA) capable of dissolving the resist 6 were mixed to form a mixed solvent capable of dissolving the resist 6, and the mixed solvent was selected as the solvent. As the photo-acid-generating agent, a photo-acid-generating agent composed of triaryl sulfonium salt was selected.

Further, in order to set the sensitivity of the water repellent agent 7 to exposure light to a sensitivity (low sensitivity) lower than the sensitivity of the resist 6 to exposure light, an addition amount of a photo-acid-generating agent to be contained in the water repellent agent 7 was set to half an addition amount of a photo-acid-generating agent to be contained in the resist 6. The term "low sensitivity" in this example means that an amount of acid generated by the same exposure amount is small.

Here, in this example, since the same kind of the photo-acid-generating agent was selected as the photo-acid-generating agent of the resist 6 and the photo-acid-generating agent of the water repellent agent 7, by adjusting an addition amount of the photo-acid-generating agent, the sensitivity of the water repellent agent 7 was made lower than the sensitivity of the resist 6. However, the kind of the photo-acid-generating agent of the resist 6 and the kind of the photo-acid-generating agent of the water repellent agent 7 may be different from each other. In this case, a photo-acid-generating agent having an acid strength weaker than the acid strength of the photo-acid-generating agent of the resist 6 is selected as a photo-acid-generating agent to be contained in the water repellent agent 7.

The film thickness of the compatible layer 14 formed by coexistence of the water repellent agent 7 and the resist 6 changes depending on an addition amount of PGMEA contained in the water repellent agent 7, an operation time from an applying process to a drying process, and a drying condition. In this example, the applying condition of the water repellent agent 7 and the addition amount of the solvent were adjusted so as to apply PGMEA in an amount of 1.5E-10 [cc] per 1 μm$^2$, the operation time from the applying process to the drying process was made 15 seconds, and the drying condition was set to conduct the drying process at a temperature of 50° C. for 10 minutes. As a result, the compatible layer 14 with a film thickness of 1.5 μm was formed. Here, since the compatible layer 14 is a compatible layer of the resist 6 and the water repellent agent 7 having sensitivity lower than that of the resist 6, the compatible layer 14 is a layer having a middle sensitivity between the respective sensitivities of the resist 6 and the water repellent agent 7.

After the compatible layer 14 was formed, as shown in FIG. 7F, the exposing process and the PEB were performed for the ejection port pattern and the water repellent region 21. The exposing process was performed with an exposure amount of 5000 [J/m$^2$] and the PEB was performed on the conditions of a temperature of 85° C. and a processing time of 5 minutes. At this time, in the compatible layer 14, gradation was formed such that the sensitivity became high gradually from the ejection port forming surface 2*a* side toward the substrate 1 side. Subsequently, a portion where such the gradation of the sensitivity was formed was exposed to light, whereby it became possible to form a slope.

On the conditions at this time, the formed ejection port 11 was enabled to have an aperture end portion 11*a* in which the x direction width on the ejection port forming surface 2*a* side was 2 μm, and the z-direction depth was 1.5 μm.

Finally, as shown in FIGS. 7F and 7G, the laminating material was developed, and the liquid chamber forming layer 5 was removed. By the above processes, also in this example, the ejection port 11 was enabled to be formed such that the area of an aperture on the ejection port forming surface 2*a* was made larger than the area of an aperture at the ejection direction upstream side, and the aperture end portion 11*a* had a slope S.

EXAMPLE 2

Although the basic conditions were the same as Example 1, the solvent added to the water repellent agent 7 was changed from PGMEA to tetrahydrofuran (hereinafter, referred to as "THF"). As compared with PGMEA, since THF has a low boiling point (67° C. in THF in contrast with 146° C. in PGMEA) and a high saturated vapor pressure (under an atmosphere of 20° C., 141.8 mmHG in THF in contrast with 28.5 mmHG in PGMEA), THF tends to volatilize easily. Accordingly, a depth of penetration of the solvent became shallow. Therefore, although the compatible layer 14 with a film thickness of 1.5 μm was formed in Example 1, the compatible layer 14 with a film thickness of 0.7 μm was formed in this example.

EXAMPLE 3

Although the water repellent agent 7 containing the water repellent component was applied on the resist 6 in Example 1, in this example, a material (referred to as "second negative type photosensitive resist") in which the water repellent component was removed from the water repellent agent 7, was applied on the resist 6. However, an ejection port with the same shape as Example 1 was enabled to be formed. The water repellent component contained in a water repellent agent does not take any part in patterning. Accordingly, in the case where an example is conducted with the same processes as Example 1, the film thickness of a compatible layer 14 formed by the resist 6 and the second negative type photosensitive resist and the shape of an ejection port after development became the same as Example 1 in which the water repellent agent 7 was used.

In this way, even in the case where a water repellent component is removed from the water repellent agent 7, an ejection port can be formed such that an aperture end portion 11*a* of the ejection port is not likely to come in contact with a wiper blade as with Example 1.

Other Embodiments

In the above-mentioned embodiment, description is given by taking an example in which a printing head is used for an ink jet printing apparatus as a liquid ejection head. However, the manufacturing method of the present invention can be applicable also to biochip production and a liquid ejection head for use in electronic circuit printing. Here, examples of the liquid ejection head include ahead for use in production of color filters in addition to an ink jet printing head.

Further, in the above-mentioned embodiment, the liquid chamber forming layer 5 was formed by using the molding member. On the other hand, the liquid chamber forming layer 5 may be formed by using a latent imaging method. For example, a dry film formed with a negative type photosensitive resin is coated on a substrate 1, and then, an exposing process with a pattern to form a liquid chamber and PEB are performed. Although the obtained layer is made to a liquid chamber forming layer 5, the liquid chamber forming layer 5 is not subjected to a developing process, and is made in a latent image condition. The end portion of the liquid chamber forming layer 5 is made eventually to form a wall of a liquid chamber together with the resist 6. Then, the resist 6 is formed on the liquid chamber forming layer 5, and the same processes as the above-mentioned embodiment are performed. With the processes, a printing element substrate 101 in which ejection ports 11 with the above-mentioned shape are disposed can be produced.

Here, the process shown in FIG. 7B described in the above-mentioned embodiment may be omitted. That is, the process shown in FIG. 7B may be omitted, and the compatible layer 14 of the resist 6 and the water repellent agent 7 may be formed over the whole region. Further, the exposure mask 13 should not be limited to the example shown in FIG. 7F. That is, as long as portions used as ejection ports are shielded from light, all portions other than the portions may be exposed to light.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-233787, filed Nov. 12, 2013, which is hereby incorporated by reference herein in its entirety.

What is claimed is:

1. A method of manufacturing a substrate for a liquid ejection head including an ejection port forming member which has formed therein ejection ports opened to a surface for ejection liquid, the method comprising the steps of:

forming a first layer by using a first layer forming member containing a solvent and a photo-acid-generating agent;

forming a second layer on the first layer by using a second layer forming member containing a solvent and a photo-acid-generating agent; and hardening a partial region of each of the first layer and the second layer and removing a region different from the partial region so as to form the ejection ports, resulting in that the first layer and the second layer constitute the ejection port forming member, wherein a member containing a solvent to dissolve the first layer forming member and a photo-acid-generating agent having an acid strength weaker than an acid strength of the photo-acid-generating agent contained in the first layer forming member is used as the second layer forming member, and wherein an absolute value of a difference between a solubility parameter of the second layer forming member and a solubility parameter of the first layer forming member is a predetermined value that is four or less.

2. The method according to claim 1, wherein the acid strength of the photo-acid-generating agent contained in the second layer forming member is made weaker than the acid strength of the photo-acid-generating agent contained in the first layer forming member by adjusting an amount of the photo-acid-generating agent contained in the second layer forming member.

3. The method according to claim 1, wherein the solvent contained in the second layer forming member has a boiling point lower than a boiling point of the solvent contained in the first layer forming member.

4. The method according to claim 1, wherein the second layer forming member contains a water repellent component.

5. A substrate for a liquid ejection head, manufactured by the method according to claim 1.

6. A liquid ejection head, comprising:

the substrate according to claim 5; and an electric wiring member electrically connected to the substrate.

7. A printing apparatus for printing an image on a printing medium, the printing apparatus comprising the liquid ejection head according to claim 6.

* * * * *